United States Patent [19]

Luke

[11] Patent Number: 4,480,644

[45] Date of Patent: Nov. 6, 1984

[54] MANUFACTURE OF CIGARETTES

[75] Inventor: John A. Luke, Eastleigh, England

[73] Assignee: British-American Tobacco Company Limited, London, England

[21] Appl. No.: 402,253

[22] Filed: Jul. 27, 1982

[30] Foreign Application Priority Data

Aug. 3, 1981 [GB] United Kingdom ..... 8123699

[51] Int. Cl.[3] ..... A24C 5/14; A24D 1/02

[52] U.S. Cl. ..... 131/68; 131/84 R; 131/92; 131/365

[58] Field of Search ..... 131/280, 68, 77, 92, 131/365, 84 R, 84 A, 84 B, 84 C, 94, 95

[56] References Cited

U.S. PATENT DOCUMENTS 4,366,826 1/1983 Horsewell ..... 131/365

FOREIGN PATENT DOCUMENTS 1575910 10/1980 United Kingdom ..... 131/62

*Primary Examiner*—V. Millin

*Attorney, Agent, or Firm*—Kane, Dalsimer, Kane, Sullivan and Kurucz

[57] ABSTRACT

For manufacturing rod for cigarette use, rod filler and paper wrapper web are fed continuously to a rod-forming machine in which wrapper web is wrapped about said filler to provide rod and the wrapper is longitudinally lap seamed by bringing heated sealing means into contact with the outer of overlapping web portions intended to provide the seam, one at least of said portions comprising at least 50% by weight of thermoplastic fibers or filaments. The rod filler and paper wrapping web, comprising at least 50% by weight of thermoplastic fibers or filaments, may be fed to the rod-forming device with the margins of the web overlapping and the heated sealing means brought into contact with one of the overlapping margins. The machine may be a cigarette-making machine or a filter-rod making machine.

5 Claims, 2 Drawing Figures

MANUFACTURE OF CIGARETTES

The present invention relates to the manufacture of rod for cigarette use. The term "rod for cigarette use" is intended to include tobacco rod, that is rod comprising tobacco or other smoking material enwrapped in a cigarette wrapper, and filter rod from which are to be derived individual cigarette filter elements.

In the well-established orthodox method of manufacturing tobacco rod, cigarette wrapper web and cut tobacco are fed continuously to the garniture of a cigarette-making machine. In the garniture, the wrapper web is caused to be progressively wrapped about the cut tobacco to form eventually a rod of circular cross section with margins of the wrapper web in overlapping relationship. Before the final form of the rod is attained in the garniture, a stage occurs in which the margin of the wrapper web which is to be the other of the overlapping margins projects upwardly. At this stage adhesive is coated onto the upwardly extending marginal portion of the wrapper web so that when the margins of the wrapper web are subsequently brought into the overlapping relationship a continuous longitudinal lap seam is formed. The adhesive employed may be a waterbased adhesive or a hot-melt adhesive.

Filter rod also is commonly currently manufactured in a similar fashion. That is to say, rod comprised of a fibrous filter tow enwrapped in a paper-plugwrap web is formed by feeding filter tow and plugwrap web continuously to the garniture of a rod making machine. Again, at a stage of the rod formation an adhesive is applied to a margin of the web.

The application of adhesive to a continuous paper web in a cigarette or a filter-rod making machine gives rise to a number of problems. For example, the flow rate of adhesive must be accurately controlled. If the flow rate is too high, gumming up of the garniture or other surfaces of the making machine may result and the machine may have to be stopped frequently in order to remove the adhesive. If the flow rate of adhesive is too low, or if it is interrupted, a faulty longitudinal seam will result.

Characteristics of the adhesive, such as viscosity and tackiness, must be carefully controlled if satisfactory application to the web and an adequate sealing function are to be maintained. Another factor which must be accurately monitored to ensure correct seam formation is the height of the upwardly extending marginal web portion.

It is an object of the present invention to provide a method of manufacturing rod for cigarette use in which problems associated with the application of seam adhesives are avoided.

The present invention provides a method of manufacturing rod for cigarette use wherein rod filler and paper wrapper web are fed continuously to a rod-forming device of a rod-forming machine whereby said wrapper web is wrapped about said filler to provide rod and said wrapper is longitudinally lap seamed by bringing heated sealing means into contact with one of the overlapping web portions intended to provide the seam, one at least of said portions comprising at least 50% by weight of thermoplastic fibres or filaments. In one form of the aforesaid method, the rod filler and paper wrapper web, comprising at least 50% by weight of thermoplastic fibres or filaments are fed continuously to the rod-forming device, whereby said web is wrapped about said filler, with the web margins overlapping and heated sealing means is brought into contact with one of the overlapping web margins.

The wrapper web may be one that has been made by a conventional paper-making technique. Alternatively it may be a paper which has been manufactured by a nonwoven textile process.

Preferably the wrapper web comprises not less than 80% by weight of the thermoplastic fibres or filaments and, advantageously, not less than 90%. The wrapper web may comprise fibres or filaments of more than one thermoplastic material. Among the thermoplastic materials which may be utilised are cellulose acetate, viscose, polyethylene, polypropylene and nylon.

In order that the invention may be clearly understood and readily carried into effect, reference will now be made, by way of example, to the accompanying diagrammatic drawing, in which.

Figure 1:
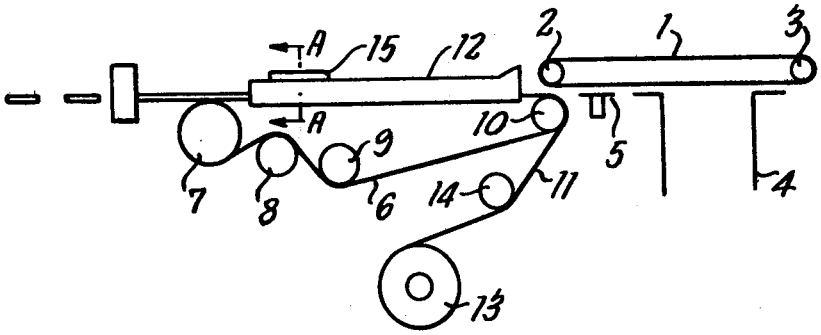
FIG. 1 shows a cigarette making machine.

The cigarette making machine of FIG. 1 is operable to produce, at high speed, continuous cigarette tobacco rod. The machine comprises an endless suction band 1 trained about rollers 2, 3, one of which is rotatable by drive means (not shown). Tobacco is induced by suction means to travel up a chimney 4, whereby it is deposited as a layer on the under surface of the lower run of the suction band 1. The layer of tobacco on the band 1, after it has advanced from over the chimney 4, is trimmed to desired depth by means of a pair of ecriteur discs, only one of which, designated 5, is shown in FIG. 1. The layer of trimmed tobacco is transferred from the band 1 to a continuous garniture tape 6. The tape 6 is trained about a drive pulley 7 (driven by means not shown) and pulleys 8, 9, and 10. The tape 6 serves to convey the tobacco and a continuous web of cigarette paper 11 into and through a rod-forming garniture 12. The web 11 is supplied from a bobbin 13 and is trained about a guide pulley 14. The paper web 11 is formed of or comprises thermoplastic fibres or filaments, e.g. polyethylene fibres or filaments.

Figure 2:
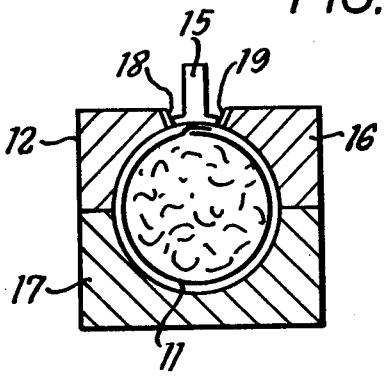
FIG. 2 shows, to an enlarged scale, a cross sectional view on A—A of FIG. 1.

In the garniture 12 the paper web 11 is caused to be wrapped about the tobacco to produce a wrapped rod of circular cross section, such as is illustrated in FIG. 2. At an upper location of the formed rod the margins of the web 11 are overlapped as shown in that figure. The outer, i.e. upper, of the web margins comes into contact with an elongate heated sealing shoe 15 mounted in the garniture 12. Since the paper web 11 is of a thermoplastic nature, the action of the heated shoe 15 on the overlapping margins of the web 11 causes the margins to be heat-sealed to each other. Thus no adhesive application to the web 11 is required.

As may be seen from FIG. 2, the garniture 12 comprises upper and lower members 16, 17. The sealing shoe 15 is disposed in an upper opening in the upper member 16 of the garniture 12. Strips of thermal insulating material 18, 19 are interposed between the shoe 15 and adjacent surfaces of the portion 16 of the garniture 12.

As will be known to those skilled in the cigarette-making art, cigarette filter rod may be manufactured on a filter-rod maker which is constructed and operates in a manner similar to that of the cigarette maker of FIG. 1. However, in the manufacture of conventional filter rod, instead of tobacco being fed through a chimney to a suction band, bloomed, plasticized filter tow, of continuous crimped cellulose acetate fibres for example, is fed, together with plugwrap web to the garniture via a condensing horn situated at the entry of the garniture. If in such a filter-rod making machine, the garniture incorporates a heatable sealing shoe similar to the shoe 15 of FIG. 1, and the plugwrap web is of a thermoplastic nature, then a continuous longitudinal lap seam may be formed in the plugwrap web without the application of adhesive. Such thermal sealing of the lap seam in the manufacture of filter rod is applicable to other than filter rod comprising a continuous length of tow. Thus, for example, heat sealing of thermoplastic plugwrap web may be applied in the case of rod comprising alternating elements of differing nature and intended for providing dual or triple filters.

For the manufacture of filter rod comprising filter plugs alternating with bodies of particulate material, a form of method is known according to which a first portion of plugwrap, of a width less than the circumference of the filter plugs, is wrapped about the spaced-apart filter plugs, the particulate material is fed into the cavities bounded by the plugwrap and the end faces of the plugs, and a second, sealing portion of plugwrap is applied to close the gap between the edges of the first plugwrap portion, Such a method is described and illustrated in, for example, United Kingdom Patent Specification No. 1,544,116, to which reference may be made for fuller disclosure. The present invention can be employed in carrying out this known method, provided that one or both of the first and second plugwrap portions are of a thermoplastic nature.

What is claimed:

1. A method of manufacturing rod for cigarette use, wherein rod filler and paper wrapper web are fed continuously to a rod-forming device of a rod-forming machine whereby said wrapper web is wrapped about said filler to provide rod and said wrapper is longitudinally lap seamed without the application of an extraneous adhesive by bringing heated sealing means into contact with one of overlapping web portions intended to provide the seam, one at least of said portions comprising at least 50% by weight of thermoplastic fibres or filaments, whereby said heated sealing means effects heat-sealing of said overlapping portions.

2. A method according to claim 1, wherein the rod filler and the paper wrapping web, comprising at least 50% by weight of thermoplastic fibres or filaments, are fed to the rod-forming device without supplying an extraneous adhesion lapping and the heated sealing means is brought into contact with one of the overlapping margins of the web whereby said rod margins seal to each other.

3. A method according to claims 1 or 2, wherein the rod-forming machine is a making machine.

4. A method according to claim 1, wherein the rod-forming machine is a filter-rod making machine.

5. A method according to claim 4, wherein the lap seam is formed between edges of wrapper-sealing portions of web.

* * * * *